US008944850B2

(12) United States Patent
Simmel et al.

(10) Patent No.: US 8,944,850 B2
(45) Date of Patent: Feb. 3, 2015

(54) SHIELDING FOR EDGE CONNECTOR

(71) Applicant: Apple Inc., Cupertino, CA (US)

(72) Inventors: George Marc Simmel, Cupertino, CA (US); Joshua Funamura, San Jose, CA (US)

(73) Assignee: Apple Inc., Cupertino, CA (US)

( * ) Notice: Subject to any disclaimer, the term of this patent is extended or adjusted under 35 U.S.C. 154(b) by 136 days.

(21) Appl. No.: 13/657,540

(22) Filed: Oct. 22, 2012

(65) Prior Publication Data

US 2014/0113490 A1 Apr. 24, 2014

(51) Int. Cl.
*H01R 9/03* (2006.01)
*H01R 13/658* (2011.01)

(52) U.S. Cl.
CPC ..... *H01R 13/658* (2013.01); *H01R 13/65802* (2013.01)
USPC ..... 439/607.55

(58) Field of Classification Search
CPC ..... H01R 13/658; H01R 13/65802; H01R 23/6873; H01R 23/7073; H01R 23/025
USPC ..... 439/607.55, 607.4, 607.35, 607.58
See application file for complete search history.

(56) References Cited

U.S. PATENT DOCUMENTS

| | | | | |
|---|---|---|---|---|
| 4,983,127 | A * | 1/1991 | Kawai et al. | 439/79 |
| 5,842,885 | A * | 12/1998 | Takamoto et al. | 439/607.01 |
| 6,047,890 | A * | 4/2000 | Reichardt et al. | 235/441 |
| 6,464,537 | B1 * | 10/2002 | Letourneau et al. | 439/607.14 |
| 6,666,702 | B1 * | 12/2003 | Pickles | 439/328 |
| 6,676,449 | B2 * | 1/2004 | Ji et al. | 439/607.35 |
| 6,767,224 | B2 * | 7/2004 | Wu | 439/79 |
| 7,048,567 | B2 * | 5/2006 | Regnier et al. | 439/329 |
| 7,442,089 | B2 * | 10/2008 | Regnier | 439/637 |
| 7,661,988 | B1 * | 2/2010 | He et al. | 439/607.32 |
| 7,731,534 | B1 * | 6/2010 | Yuan et al. | 439/607.4 |
| 7,744,416 | B2 * | 6/2010 | Zhang et al. | 439/607.11 |
| 7,828,598 | B2 * | 11/2010 | Wang | 439/607.27 |
| 7,845,965 | B2 * | 12/2010 | Ko | 439/352 |
| 7,988,462 | B2 * | 8/2011 | Mao et al. | 439/79 |
| 8,317,542 | B2 * | 11/2012 | Abraham | 439/607.31 |
| 8,449,322 | B2 * | 5/2013 | Cai | 439/541.5 |
| 8,556,662 | B2 * | 10/2013 | Wang et al. | 439/630 |
| 8,662,925 | B2 * | 3/2014 | Gao et al. | 439/607.35 |
| 2006/0009080 | A1 * | 1/2006 | Regnier et al. | 439/637 |

* cited by examiner

*Primary Examiner* — Amy Cohen Johnson
*Assistant Examiner* — Vladimir Imas
(74) *Attorney, Agent, or Firm* — Kilpatrick Townsend & Stockton LLP

(57) ABSTRACT

Connectors having improved signal paths. An illustrative embodiment of the present invention may provide a connector having a pair of first contacts adjacent to each other. Two second contacts may be located on each side of and adjacent to the pair of first contacts. The second contacts may include a front beam portion that contacts a front shield located along a front face of the connector. The front shield may in turn connect to a top shield that at least partially covers a top, sides, and back of the connector.

27 Claims, 4 Drawing Sheets

SHIELDING FOR EDGE CONNECTOR

BACKGROUND

The numbers and types of electronic devices available to consumers has grown tremendously the past few years. Tablet computers, netbooks, laptops, desktops, and all-in-one computers, media players, handheld media players, cell phones, smart phones, and other devices have proliferated. These devices have proliferated not only in the types that are available, but also as in the functionality they include.

Moreover, options for some particular devices have also proliferated. For example, for a particular device, the size of an internal memory may be an option. Other functionalities, such as video or graphics cards, network connections, and others, may also be made available as options or as possible upgrades. This allows a manufacturer to offer products at several price points, and allows customers to buy only the amount of functionality that is required to suit their needs and to possibly upgrade at a later time.

With these devices, various options may be added by including an optional card or board inside a housing of the electronic device. Also, certain cards or boards may be manufactured separately, for example, by a different manufacturer. In these and other situations, it may be desirable to include the card in the electronic device as a daughter card or board. These optional or daughter cards or boards may be attached to a main or motherboard. Specifically, these optional or daughter cards or boards may be attached to a board inside the electronic device housing using a connector. These cards may be memory cards, networking, or other types of cards.

Recently, the speed of these cards has been increasing greatly, as the amount of data that these electronic devices process has skyrocketed. The speed of memory cards, networking cards, and other types of cards and devices has greatly increased.

Unfortunately, connectors are often a limiting factor in a device's speed. Unmatched terminations, reflections, and cross coupling at connectors may limit the operating frequency of device or card inserted in a connector.

Thus, what is needed are connectors that may provide improved signal paths that may allow a higher operating frequency for inserted devices or cards.

SUMMARY

Accordingly, embodiments of the present invention may provide connectors having improved signal paths. An illustrative embodiment of the present invention may provide a connector having a pair of first contacts adjacent to each other. Two second contacts may be located on each side of and adjacent to the pair of first contacts. The second contacts may include a front beam portion that contacts a front shield located along a front face of the connector. The front shield may in turn connect to a top shield that at least partially covers a top, sides, and back of the connector.

In this configuration, the pair of first contacts has a contact on each side that is connected to a front shield. The pair of first contacts has the front shield on another side, and the top shield on the remaining side. That is, the pair of first contacts is close to being surrounded by ground connections. Noise coupling to the pair of first contacts, as well as termination and reflection problems, are greatly reduced. Accordingly, the pair of first contacts may provide a high speed differential signal path.

Various embodiments of the present invention may include other types of contacts. For example, third contacts having a greater width than the first and second contacts may be provided for the purpose of conveying power. These contacts may be placed at the ends of the connector, or elsewhere in the connector. The contacts may include tail portions to be connected to traces on a main logic board, flexible circuit board, or other appropriate substrate. These tail portions may be surface mount contacts, through-hole contacts, or other type of contacts. Openings in the front shield may provide for the visual inspection of connections between these contact tail portions and traces on a main logic board.

The contacts may be located in a housing, and each included contact may include a contacting portion along a top of the housing. A top shield may be located over the top of the housing. A cards or device may be inserted between an underside of the top shield and the top of the housing. The underside of the top shield may form a ground connection to the card or device, the first contacts may provide signal paths, the second contacts may provide ground paths, and the third contacts may provide power.

An illustrative embodiment of the present invention may provide a connector. This connector may form a plurality of signal paths between a printed circuit board and a card. The connector may include an insulative housing having a number of slots formed along a front and top. The connector may further include a plurality of first contacts, each having a first portion extending away from a bottom of the housing to attach to a contact on a surface of the printed circuit board, a second portion extending along a front of a slot in the housing, and a third portion extending along a top of a slot in the housing. The connector may further include a plurality of second contacts, each having a first portion extending away from the bottom of the housing to attach to a contact on a surface of the printed circuit board, a second portion extending along a front of a slot in the housing, a third portion extending along a top of a slot in the housing, and a fourth portion extending from the second portion away from the housing. Shielding around the connector may include a top shield over at least a top of the insulative housing, and a front shield along the front of the housing and contacting the fourth portions of the plurality of second contacts.

An illustrative embodiment of the present invention may provide a method of manufacturing a connector. This method may include receiving an insulative housing having a number of slots formed along a front and top, inserting a plurality of first contacts in slots in the housing, inserting a plurality of second contacts in slots in the housing, and attaching a front shield to the housing by inserting tabs on the front shield into the housing. The front shield may contact first portions of each of the plurality of second contacts, the first portion of each of the plurality of second contacts extending from a body of the contact away from the housing.

Cards or devices may be inserted between the top shield and contacts at the top of the housing. These cards or device may include graphics cards, wireless networking cards, memory devices, solid state drives, and other types of cards and devices.

Embodiments of the present invention may provide connectors for various types of devices, such as portable computing devices, tablets, desktop computers, laptops, all-in-one computers, cell phone, smart phones, media phones, storage devices, portable media players, navigation systems, monitors and other devices.

Various portions of connector these connectors may be formed of various materials. For example, the housings may be formed of silicon or silicone, rubber, hard rubber, plastic, nylon, liquid-crystal polymers (LCPs), or other nonconductive material or combination of materials. The contacts and shields may be formed of stainless steel, steel, copper, copper titanium, phosphor bronze, or other material or combination of materials. They may be plated or coated with nickel, gold, or other material.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
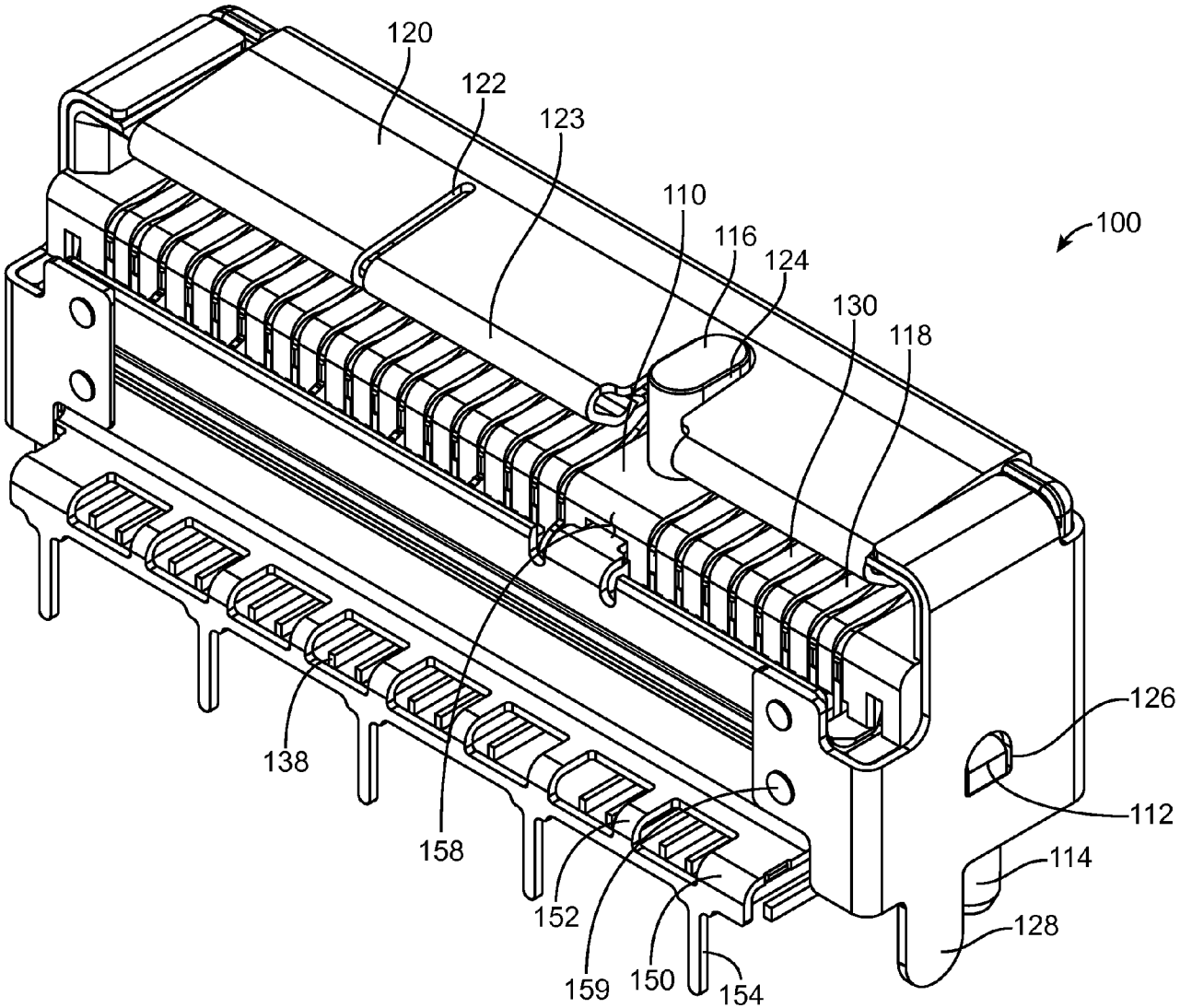
FIG. 1 illustrates a top oblique view of a connector according to an embodiment of the present invention.

FIG. 1 illustrates a top oblique view of a connector according to an embodiment of the present invention. This figure, as with the other included figures, is shown for illustrative purposes and does not limit either the possible embodiments of the present invention or the claims. Also, the description below may make reference to common reference numbers among different figures. For brevity and to maintain readability, this is not redundantly pointed for each occurrence.

Connector 100 may include housing 110. Housing 110 may include a number of slots 118 holding contacts 130, and possibly other contacts, as shown in the following figures. Housing 110 may further include posts 114. Posts 114 may be located in openings on a main logic board or other appropriate substrate for mechanical stability. Housing 110 may further include keying feature 116, which prevent the inadvertent or upside down insertion of a card or device into connector 100.

Connector 100 may further include top shield 120, which may be located over a top, back, and sides of housing 110. Top shield 120 may include cutout 126, which may accept tab 112 on housing 110. Top shield 120 may further include tabs 128, which may be located in a main logic board or other appropriate substrate. Tabs 128 may provide a ground connection. Top shield 120 may be at least partially divided by separations 122 and 124. Separations 122 and 124 may improve contacts between top shield 120 and ground contacts on a top of a board or device inserted into connector 100. Front edge 123 of top shield 120 may be folded underneath itself. This may provide an amount of spring or retention force to hold a card or device in place when it is inserted into connector 100.

Front shield 150 may attach to top shield 120 at laser or spot weld locations 159, and it may reside along a front face of housing 110. Openings 152 in front shield 150 may allow for the inspection of contact tail portions 138 of contacts 130 when a contact tail portions 138 are connected to contacts on a main logic board or other appropriate substrate. Tabs 158 on front shield 150 may be inserted into to openings and housing 110.

Figure 2:
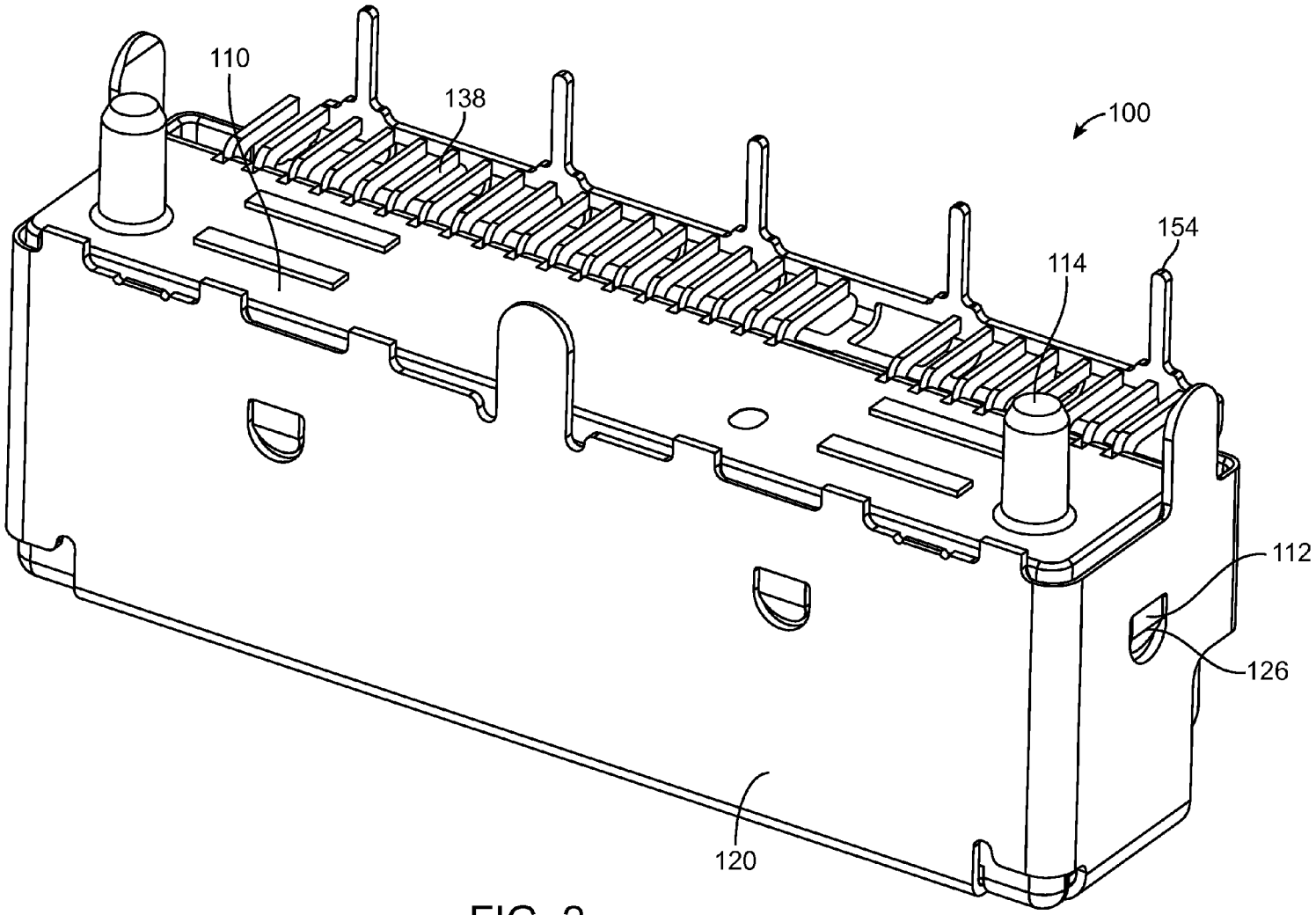
FIG. 2 illustrates a bottom oblique view of a connector according to an embodiment of the present invention.

FIG. 2 illustrates a bottom oblique view of a connector according to an embodiment of the present invention. Again, housing 110 may provide support for contacts not shown, which may have contact tail portions 138. Housing 110 may further include posts 114 that may be located in a main logic board or other appropriate substrate for mechanical stability. Top shield 120 may cover a top, side, and back of housing 110. Cutout 126 on top shield 120 may accept tab 112 on housing 110. Front shield 150 (not shown) may include tabs 154 and top shield 120 may include tabs 128 to form ground connections with traces on a main logic board or other appropriate substrate.

Figure 3:
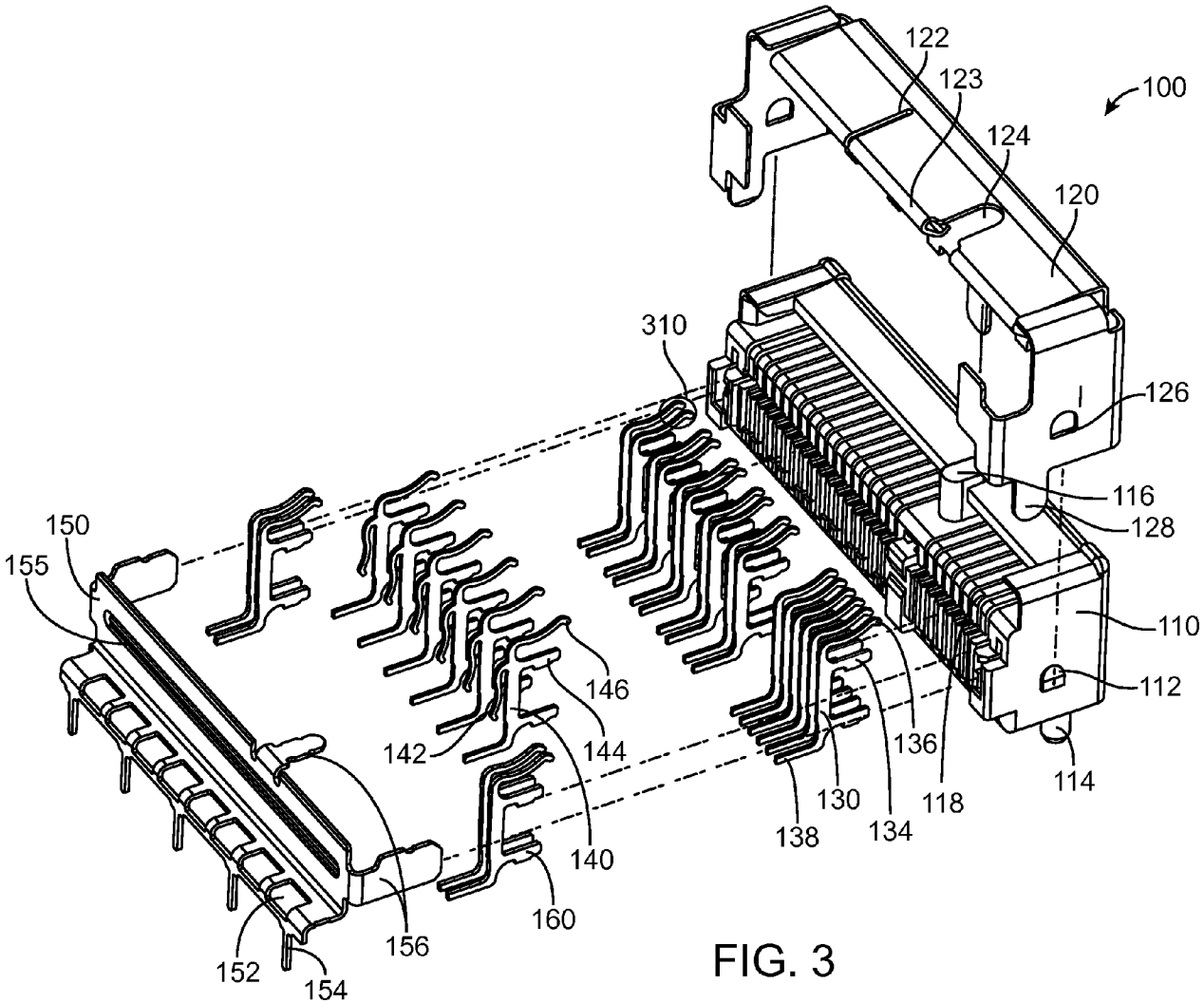
FIG. 3 illustrates an exploded view of a connector according to an embodiment of the present invention.

FIG. 3 illustrates an exploded view of a connector according to an embodiment of the present invention. Connector 100 may include housing 110. Housing 110 may include keying feature 116 to prevent inadvertent or upside down insertion of a card or device into connector 100. Housing 110 may further include tabs 112 to fit in cutout 126 on top shield 120. Top shield 120 may include dividers 122 and 124 to improve connection between top shield 120 and a ground contact on a top of card or device inserted into connector 110. Housing 110 may include slots 118 along a front and top. First contacts 120 may be inserted into slots 118. Specifically, tabs 134 may be inserted into housing 110. A main body of these contacts may reside in a slot portion of a front of the housing, while a contacting portion 136 may reside in the slots along the top of housing 110. Contacts 130 may include contact until portions 138. Contact tail portions 138 may be through-hole, surface mount, or other types of contacts.

Second contacts 140 may include a front beam portion 142. Front beam portion 142 may extend from the main body away from housing 110. Front beam portion 142 may contact front shield 150. Front shield 150 may include tabs 156 to be inserted into housing 110. Front shield 150 may further include openings 152 through which contacts formed at contact tail 138 may be inspected after connector 100 is assembled to a main logic board or other appropriate substrate. Tabs 154 may be located in a Main logic board or other appropriate substrate. Front shield 150 may include indentation 155 to improve electrical connections to beam portions 142 of second contacts 140.

In various embodiments of the present invention, additional contacts, such as contacts 160 may be included. Contacts 160 may have a width that is greater than the first contacts 120 or second contacts 130. These contacts may be appropriate for providing power to a device inserted in connector 100. In this configuration, pairs 310 of first contacts 130 may be adjacent to each other, and the pair 310 may be adjacent on each side to a second contact 140. Second contacts 140 may be grounded. Front shield 150 may be located in front of pair 310 of first contacts 120, while top shield 120 may be above and behind this pair of contacts. Accordingly, pairs 310 of first contacts 120 may be well-shielded by ground connections. This shielding may reduce cross-talk, reduce termination and reflection problems, and improve overall signal quality. This in turn may allow devices or cards inserted into connector 100 to operate at higher frequencies.

Figure 4:
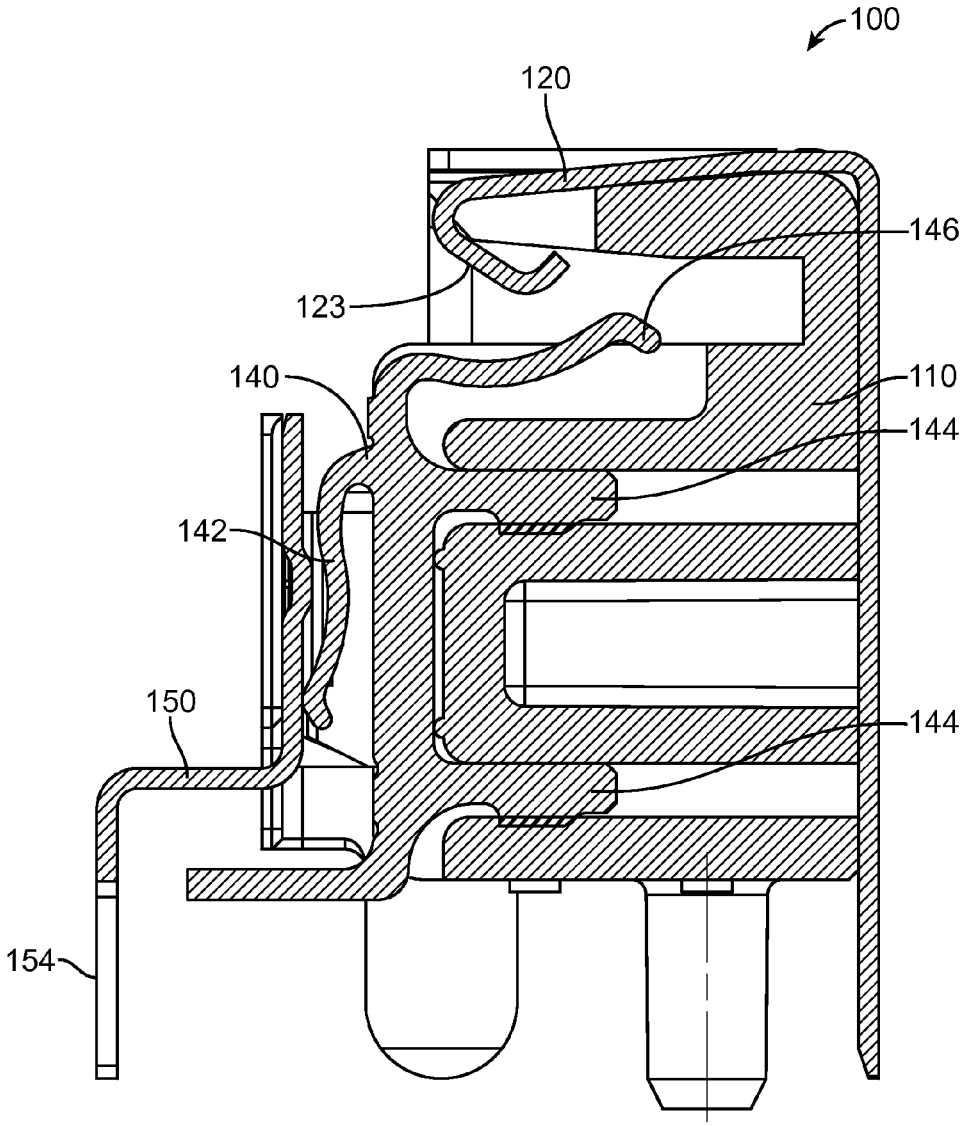
FIG. 4 illustrates a side view of a connector according to an embodiment of the present invention.

FIG. 4 illustrates a side view of a connector according to an embodiment of the present invention. Again, top shield 120 may include a portion 123 folders onto itself. This portion may act as a ground contact for a top of a card or device inserted into connector 100. Second connector 140 may include beam 142 that may make an electrical connection with front shield 150. Tabs 144 may be inserted into housing 110 of connector 100 for mechanical stability purposes. Contact tail portion 128 may form an electrical connection with a trace on a main logic board or other appropriate substrate. Cards or devices may be inserted between top shield portion 123 and contact portion 146. These cards or device may include graphics cards, wireless networking cards, memory devices, solid state drives, and other types of cards and devices.

Embodiments of the present invention may provide connectors for various types of devices, such as portable computing devices, tablets, desktop computers, laptops, all-in-one computers, cell phone, smart phones, media phones, storage devices, portable media players, navigation systems, monitors and other devices.

Various portions of connector these connectors may be formed of various materials. For example, the housings may be formed of silicon or silicone, rubber, hard rubber, plastic, nylon, liquid-crystal polymers (LCPs), or other nonconductive material or combination of materials. The contacts and shields may be formed of stainless steel, steel, copper, copper titanium, phosphor bronze, or other material or combination of materials. They may be plated or coated with nickel, gold, or other material or combination of materials.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector to form a plurality of signal paths between a printed circuit board and a card, the connector comprising:

an insulative housing having a number of slots formed along a front and top;

a plurality of first contacts, each having:

a first portion extending away from a bottom of the housing to attach to a contact on a surface of the printed circuit board;

a second portion extending along a front of a slot in the housing; and a third portion extending along a top of a slot in the housing;

a plurality of second contacts, each having:

a first portion extending away from the bottom of the housing to attach to a contact on a surface of the printed circuit board;

a second portion extending along a front of a slot in the housing;

a third portion extending along a top of a slot in the housing; and a fourth portion extending from the second portion away from the housing;

a top shield over at least a top of the insulative housing; and a front shield along the front of the housing and contacting the fourth portions of the plurality of second contacts.

2. The connector of claim 1 wherein a pair of the plurality of first contacts are adjacent contacts to each other, and one of the plurality of second contacts are adjacent contacts to the pair of first contacts.

3. The connector of claim 1 further comprising:

a plurality of third contacts, each having:

a first portion extending away from a bottom of the housing to attach to a contact on a surface of the printed circuit board;

a second portion extending along a front of a slot in the housing; and a third portion extending along a top of a slot in the housing, wherein a width of the contacts in the third plurality of contacts is wider than a width of the contacts in the pluralities of first and second contacts.

4. The connector of claim 3 wherein the plurality of third contacts are located at ends of the housing.

5. The connector of claim 1 wherein the plurality of first contacts and the plurality of second contacts each further comprise a first tab extending from the second portion and into the housing.

6. The connector of claim 5 wherein the plurality of first contacts and the plurality of second contacts each further comprise a second tab extending from the second portion and into the housing.

7. The connector of claim 5 wherein the first tabs provide mechanical stability.

8. The connector of claim 1 wherein the top shield and the front shield connect and provide a ground plane.

9. The connector of claim 1 wherein a portion of the top shield holds the card in place when the card is inserted into the connector.

10. The connector of claim 1 wherein the card is inserted between an underside of the top shield and the third portions of the pluralities of first and second contacts.

11. The connector of claim 1 wherein the card is a memory card.

12. The connector of claim 1 wherein the card is a solid state drive.

13. The connector of claim 1 wherein the card is a wireless networking card.

14. A method of manufacturing a connector, the method comprising:

receiving an insulative housing having a number of slots formed along a front and top;

inserting a plurality of first contacts in slots in the housing, wherein for each of the plurality of first contacts, a first portion is inserted along a front of a slot in the housing and a second portion is inserted along a top of the slot in the housing;

inserting a plurality of second contacts in slots in the housing, wherein for each of the plurality of second contacts, a first portion is inserted along a front of a slot in the housing and a second portion is inserted along a top of the slot in the housing; and attaching a front shield to the housing by inserting tabs on the front shield into the housing, wherein the front shield contacts third portions of each of the plurality of second contacts, the third portion of each of the plurality of second contacts extending from the first portion of the contact away from the housing.

15. The method of claim 14 wherein inserting a plurality of first contacts in slots in the housing comprises inserting a tab on each of the plurality of first contacts into the housing.

16. The method of claim 15 wherein the tab on each of the plurality of first contacts extends from the body of the contact towards the housing.

17. The method of claim 14 further comprising placing a top shield over at least a top of the housing and attaching the top shield to the front shield.

18. The method of claim 17 wherein an underside of the top shield and a top of the housing form an opening to receive a card.

19. The method of claim 14 further comprising inserting a plurality of third contacts into slots in the housing.

20. The method of claim 14 wherein a width of the contacts in the third plurality of contacts is wider than a width of the contacts in the pluralities of first and second contacts.

21. The method of claim 14 wherein each of the first contacts further comprises a third portion extending away from a bottom of the housing to attach to a contact on a surface of a printed circuit board, and each of the second contacts further comprises a fourth portion extending away from the bottom of the housing to attach to a contact on the surface of the printed circuit board.

22. The method of claim 14 wherein each of the second contacts further comprises a fourth portion extending away from the bottom of the housing to attach to a contact on a surface of a printed circuit board.

23. The connector of claim 1 wherein each of the first contacts and each of the second contacts are between the front shield and the housing.

24. A connector to form a plurality of signal paths between a printed circuit board and a card, the connector comprising:

an insulative housing having a number of slots formed along a front and top;

a pair of first contacts, the first contacts adjacent to each other and each having:

a first portion extending along a front of a slot in the housing; and a second portion extending along a top of a slot in the housing;

a pair of second contacts, the second contacts on opposing sides of the first pair of contacts, each having:

a first portion extending along a front of a slot in the housing;

a second portion extending along a top of a slot in the housing; and a third portion extending from the first portion away from the housing; and a front shield along the front of the housing and contacting the third portions of the plurality of second contacts.

25. The connector of claim 24 wherein the first contacts each further comprise a third portion extending away from a bottom of the housing to attach to a contact on a surface of the printed circuit board, and the second contacts each further comprise a fourth portion extending away from the bottom of the housing to attach to a contact on the surface of the printed circuit board.

26. The connector of claim 25 further comprising a top shield over at least a top of the insulative housing.

27. The connector of claim 26 wherein the card is inserted between an underside of the top shield and the third portions of the pairs of first and second contacts.

* * * * *